United States Patent [19]

Hale

[11] Patent Number: 4,746,471

[45] Date of Patent: May 24, 1988

[54] METHOD OF CONSTRUCTING A REINFORCED CONCRETE STRUCTURE

[76] Inventor: Loren E. Hale, 7301 E. 66th, Tulsa, Okla. 74133

[21] Appl. No.: 919,625

[22] Filed: Oct. 15, 1986

Related U.S. Application Data

[63] Continuation-in-part of Ser. No. 671,791, Nov. 14, 1984, abandoned, which is a continuation of Ser. No. 421,566, Sep. 22, 1985, abandoned.

[51] Int. Cl.[4] ..... E04G 11/02; E04G 11/04

[52] U.S. Cl. ..... 264/32; 52/2; 249/65; 264/33; 264/35; 264/228; 264/229; 264/314; 425/DIG. 112

[58] Field of Search ..... 264/31-34, 264/45.2, 228, 229, DIG. 50, 314; 425/817 R, DIG. 14, DIG. 112, DIG. 132; 106/90, 94, 99; 249/65; 52/2

[56] References Cited

U.S. PATENT DOCUMENTS

| | | | |
|---|---|---|---|
| 1,964,386 | 6/1934 | Nose | 249/183 |
| 2,388,701 | 11/1945 | Neff | 264/314 |
| 2,624,931 | 1/1953 | Billner | 264/314 |
| 2,892,239 | 6/1959 | Neff | 264/314 |
| 3,139,464 | 6/1964 | Bird et al. | 264/314 |
| 3,390,211 | 1/1968 | Ziegler | 264/314 |
| 3,462,521 | 8/1969 | Bini | 264/314 |
| 3,619,432 | 11/1971 | Harrington | 264/314 |
| 3,734,670 | 5/1973 | Stickler, Jr. | 425/405 R |
| 3,973,749 | 8/1976 | Friedl | 249/65 |
| 4,002,707 | 1/1977 | Oram | 264/314 |
| 4,102,956 | 7/1978 | Heifety | 264/34 |
| 4,155,967 | 5/1979 | South et al. | 264/314 |
| 4,170,093 | 10/1979 | Coppellini et al. | 264/35 |
| 4,382,820 | 5/1983 | Ivane | 106/97 |
| 4,442,059 | 4/1984 | Boyce | 264/314 |

FOREIGN PATENT DOCUMENTS

| | | | |
|---|---|---|---|
| 2701855 | 4/1977 | Fed. Rep. of Germany | 249/65 |

OTHER PUBLICATIONS

Concepts in Concrete, "Air-Inflated Forming System", sales brochure, Tulsa, OK.

"Air Formed Drainage Structures", C.I.C., Inc., sales brochure, Tulsa, OK.

*Primary Examiner*—Jay H. Woo
*Assistant Examiner*—James C. Housel
*Attorney, Agent, or Firm*—Head & Johnson

[57] ABSTRACT

A method of constructing a reinforced concrete structure (e.g. a cement building or pipeline) wherein an inflatable form is placed on a precast foundation and confined thereto by wrapping the exterior of the inflatable form with a layer of chain link fencing fabric. For large structures, a plurality of adjacent inflatable forms (preferably pneumatically interconnected) is employed wherein either the exterior interstitial spaces between adjacent forms are occupied by lightweight spacer means or structural walls and support means are present to further anchor the chain link fencing fabric. The inflatable form can then be highly pressurized such as to prestress the chain link fence and a uniform layer of fiber reinforced cement is applied to the form. The resulting thin walled structure exhibits excellent structural properties virtually free of form deformation and cement sloughing.

9 Claims, 5 Drawing Sheets

METHOD OF CONSTRUCTING A REINFORCED CONCRETE STRUCTURE

This is a continuation-in-part of co-pending application Ser. No. 671,791 filed on Nov. 14, 1984, which is a continuation-in-part of Ser. No. 421,566 filed on Sept. 22, 1982, which are now abandoned.

BACKGROUND OF THE INVENTION

1. Field of the Invention

This invention relates to the construction of a reinforced concrete structure. More specifically, the invention relates to a method of manufacturing an arched or barrel vaulted concrete structure such as a building or pipeline by applying a cementitious composition on a highly pressurized, inflatable form which is confined by steel straps and/or wire mesh.

2. Description of the Prior Art

The basic concept of manufacturing a thin walled reinforced fiber containing structure such as a building, pipe or the like is generally a well established art. However, when attempting to employ this art in combination with removable and reuseable inflatable molds or forms, the available alternative methods of construction are plagued with problems that severely limit the commercial acceptance of such techniques. Yet in principle, a reliable and safe construction technique using an inflatable mold and fiber containing cement should lead to an extremely cost effective and structurally acceptable product.

Among the problems encountered when fabricating concrete on an inflatable form has been the tendency for the form to be displaced and distorted when heavy loads of cementitious composition are applied to the form. These problems have been further complicated by the tendency of the inflatable form to vibrate and transmit relative movement during application and setting of the concrete. Various methods and techniques have been suggested and employed to compensate for such problems, particularly when building large scale cement shell structures and the like. For example, in U.S. Pat. No. 2,388,701 a "workdown" procedure for cementing a hemispherical open bottomed, inflatable form mounted on a circular foundation is disclosed. This "workdown" procedure involves the cement to the top third of the form first, thus creating a compression on the rest of the form. However, it is recognized in this patent that such a procedure induces significant distortion of the sidewalls of the dome form and resulting structure. This distortion problem is again acknowledged in U.S. Pat. No. 2,892,239 and compensated for by the use of a series of horizontal reinforced bands placed at the base of the domed top resting on vertically straight sidewalls of a circular structure. The straight sidewalls are also reinforced by bands of wire mesh wrapped around the inflatable form and again the workdown procedure is viewed as critical to create the desired structural stress Other techniques have been employed in relatively thick walled cement structure using inflatable forms such as suggested in U.S. Pat. No. 2,624,931 wherein a staged segmented casting process is employed including an intermediate pouring of the top section midway through the construction. U.S. Pat. No. 3,390,211 discloses a method of making a nuclear reactor vessel from prestressed elements and concrete wall segments which are fabricated to each other with the use of an inflatable form. In fact, when attempting to build thin walled, large scale cement structures, the problems of form distortion and movement during application and the vibration/wave motion during application and setting have resulted in extraordinary measures being employed during fabrication. For example, in U.S. Pat. Nos. 3,462,521 and 4,170,093 a method of casting the cement on the deflated form and then inflating the form and unset cement is proposed. It has also been proposed to work from within an inflated form by applying the cement to the inner surface of the form. In U.S. Pat. No. 3,619,432 the form is stabilized by the presence of a network of wire ropes suspended from the inner layer of the inflated form to which the cement is to be applied. And, in U.S. Pat. No. 4,155,967 a method of initially coating the interior of the inflated form with a sprayed on layer of insulating foam or the like and letting it set up is used prior to the application of the cement, while in U.S. Pat. No. 4,002,707 a plurality of water filled bladders stacked on each other is used to make the form.

The problem of form distortion when using an inflatable form to manufacture an arched or barrel vaulted concrete building is of particular importance and even critical when the building is intended to support an overburden such as in earthen shelters in that the structural strength of the arch is dependent on preserving the geometry of the arch. The significance of the distortion problem has been recognized in the prior art and has led to the suggestion of extraordinary remedies. For example, see U.S. Pat. No. 3,139,464 wherein triangular cross-sectional trusses are positioned along the arched roof to contribute hoop strength to the structure and inflatable form. In this patent, the two step cement pouring process is employed wherein the triangular hoop trusses are initially poured and the concrete is allowed to set up before the region between the trusses are poured. As such, the first step produces a steel reinforced arched truss system that then stabilizes the inflatable form and bears the load when the concrete roof is poured during the second step. Such a process requires the fabrication of specialized triangular trusses and the intentional incorporation of these trusses into the final concrete structure. As such, the presence of the trusses, in principle, represents an unnecessary expense. Thus, the need exists for an inexpensive yet reliable method of fabricating the arched or barrel vaulted structure directly onto the inflatable form without the use of unnecessary structural elements and without encountering the form distortion problem. The present invention is viewed as such a process.

SUMMARY OF THE INVENTION

In view of the problems associated with previous methods of manufacturing a thin walled cement structure (e.g. shell structures, buildings, pipeline and the like) using an inflatable form, I have discovered an improved method of fabrication using an entirely closed inflatable form or preferably a plurality of closed inflatable forms (optionally pneumatically interconnected) confined by a plurality of steel bands or straps and/or a wire mesh exterior (e.g., overlapping bands of chain link fence) which, when highly inflated, prestresses the bands or straps or wire mesh and creates greater load bearing capacity and dimensional stability during application of the cementitious mixture. Thus, the present invention provides a method of constructing a cement structure comprising the steps of:

(a) providing a foundation adapted to accept a plurality of closed inflatable forms in contact with each other;

(b) placing a plurality of closed inflatable forms within the foundation in contact with each other;

(c) anchoring a flexible wire mesh to the foundation such that the flexible wire mesh will conform to and substantially cover the entire exterior surface of the inflatable forms when inflated;

(d) inflating the plurality of closed inflatable forms to prestress said flexible wire mesh;

(e) applying a wet cementitious material to the prestressed wire meshed exterior of the inflatable forms; and (f) allowing the cementitious material to set and harden before deflating and removing the inflatable forms.

The present invention further provides a method of constructing a cement building comprising the steps of:

(a) providing a foundation adapted to accept a plurality of parallel cylindrical closed inflatable forms in contact with each other and further adapted to accept inner support members between the cylindrical inflatable forms;

(b) providing a plurality of interior vertical support members along the line of contact between each pair of the parallel cylindrical inflatable forms;

(c) providing a substantially horizontal, load bearing, roof support member along the line of the contact between each pair of the parallel cylindrical inflatable forms and wherein the horizontal roof support member is supported by the plurality of vertical support members;

(d) placing a plurality of parallel cylindrical inflatable forms within the foundation on each side of the substantially horizontal roof support member;

(e) anchoring a flexible wire mesh to the foundation along the sides of the foundation substantially parallel to the direction of the plurality of cylindrical inflatable forms and anchoring the flexible wire mesh to each of the horizontal roof support members such that the flexible wire mesh will conform to and substantially cover the entire exterior surface of the inflatable form when inflated;

(f) inflating the plurality of parallel cylindrical inflatable forms to prestress the flexible wire mesh;

(g) applying a wet cementitious material to the prestressed wire meshed exterior of the inflatable forms and roof support members; and (h) allowing the cementitious material to set and harden before deflating and removing the inflatable forms.

And, the present invention also provides a method of constructing a pipeline comprising the steps of:

(a) casting a cement foundation adapted to accept at least one closed cylindrical inflatable form and serve as the bottom of said pipeline;

(b) placing at least one closed cylindrical inflatable form on the foundation colinear with the direction of the pipeline;

(c) anchoring a flexible wire mesh to the foundation along both sides of the inflatable form such that the flexible wire mesh will conform to and substantially cover the cylindrical exterior portion of the form when inflated;

(d) inflating the closed cylindrical inflatable form to prestress the flexible wire mesh;

(e) applying a wet cementitious material to the prestressed wire meshed exterior of the inflatable form; and (f) allowing the cementitious material to set and harden before deflating said inflatable form thus forming a segment of said pipeline.

According to the pipeline embodiment, the pipeline is extended by casting a cement extension of the foundation in the desired direction of the pipeline. The deflated inflatable form can then be repositioned on the extension of the foundation such that one end of the form remains within the previously formed segment of the pipeline and the above steps (c) through (f) can be repeated. The flexible wire mesh employed to confine the inflatable form can be a series of partially overlapping bands of chain link fence or the equivalent.

Preferably, a series of parallel, high strength, steel straps are employed to confine the inflatable form. The wire mesh, chain link fence or equivalent can then be placed over the restraining straps. In one particularly preferred embodiment, a layer of reinforcing rod (rebar) is suspended over the inflated, steel strap restrained, cylindrical forms resulting in a high strength, arched concrete structure suitable for underground earth shelter applications. In this latter preferred embodiment, cross bracing of arched segments not containing inflated forms while other arched segments with inflated forms are having cement applied thereto allows for even greater flexibility in terms of sequential construction of the concrete structure. Preferably, oversized inflatable forms are employed within the restraining straps such as to insure a high degree of foot plant (maximum form to foundation contact) which in turn enhances the stability and resistance to form deformation at high cement loading. Preferably, the cementitious material is applied by compressed air or the like and optionally can contain fibers selected from the group consisting of steel wires, polypropylene fibers, polyethylene fibers and mixtures thereof. Optionally, the plurality of inflatable forms can be pneumatically interconnected and the exterior regions of contact between the inflatable forms can be either filled with a spacer means producing a smooth curved exterior or oversized inflatable forms can be employed and allowed to inflate and expand into these regions.

It is a primary object of the present invention to provide an inexpensive yet highly reliable method of manufacturing a thin walled, reinforced cement, arched or barrel vaulted concrete structure by use of an inflatable form. It is an associated object that the method of fabrication alleviate the previous problem of form deformation by being amenable to cement application techniques other than the "workdown" technique. It is still a further object to provide a method of fabrication that overcomes the problems of form deformation, dimensional instability, relative motion and wave action during both cementing and setting of the cement and the like by overpressurizing the inflatable form. Fulfillment of these objects and the presence and fulfillment of other objects will be apparent upon complete reading of the specification and claims taken in conjunction with the attached drawings.

DESCRIPTION OF THE PREFERRED EMBODIMENTS

Figure 1:
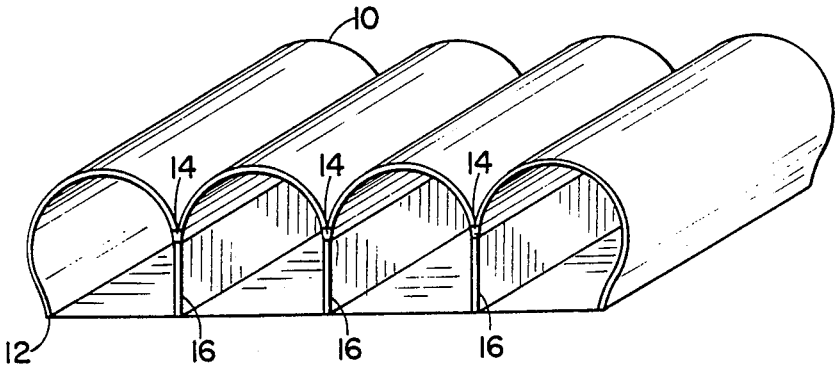
FIG. 1 is a perspective view of a barrel vaulted concrete structure manufactured according to the present invention.
Figure 2:
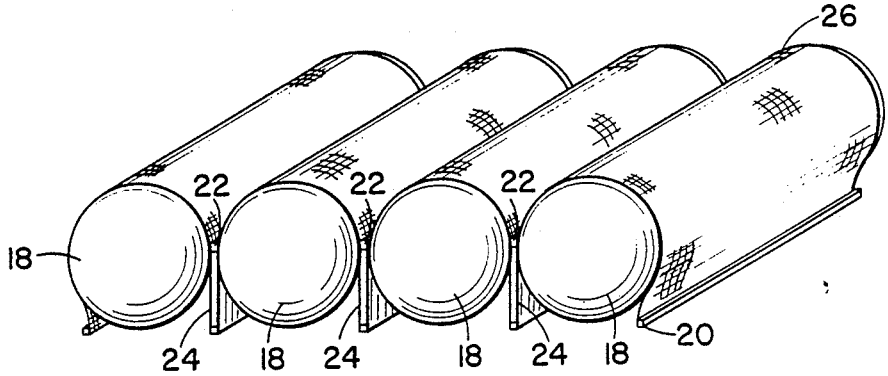
FIG. 2 is a perspective view of the wire meshed confined plurality of inflatable forms resting on a foundation with internal structural support members used to manufacture the barrel vaulted structure of FIG. 1
Figure 3:
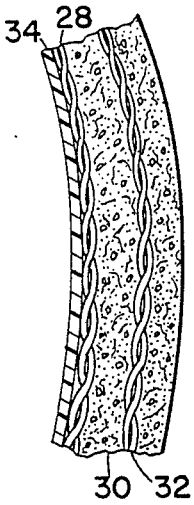
FIG. 3 is an enlarged cross-sectional view of a section of sidewall of the structure of FIG. 1 during fabrication.

The improved method of constructing a thin walled, wire mesh reinforced, concrete structure according to the present invention can perhaps be best explained and understood by reference to the drawings. FIG. 1 illustrates the finished concrete building produced according to one embodiment of the present invention which generally includes a barrel vaulted exterior reinforced concrete surface 10 resting on a precast foundation 12 with a series of internal beamed members 14 resting on posts 16. As illustrated in FIG. 2, this barrel vaulted structure is fabricated on a form made up of a series of parallel adjacent closed cylindrical balloons or inflatable bladders 18 positioned within a precast concrete foundation 20. Between each cylinder is a horizontal roof support member 22 resting on support posts 24 and elevated such as to rest essentially along the line of contact between the adjacent cylindrical inflatable forms 18. A wire mesh 26 is anchored to the foundation 20 on each side of the structure by appropriate fasteners attached to the foundation 20. The wire mesh is further attached to or anchored along the horizontal roof support members 22 thus forming a continuous barrel vaulted wire meshed reinforcing surface conformed to the exterior surface of the adjacent parallel inflatable forms. Preferably, and as illustrated in the cross-sectional view of FIG. 3, the resulting sidewalls and roof of the structure are fabricated out of at least one layer or lamination of chain link fence 28 embedded in a continuous matrix of preferably a fiber containing cement 30 which has been sequentially applied over the inflatable form 34 as described later. Once the first layer has been applied to the inflatable form and allowed to cure and harden, additional layers of chain link fence 32 and cement can be readily applied.

The actual number of layers of wire reinforced cement applied to the inflatable form can in principle vary from a single layer to several successive layers. It has been found that one layer of chain link fencing with overlapping edges and about three-fourths to one and a half inch of fiber containing cement will produce sufficient structural strength for maintaining the physical integrity of a structure with radius of curvature measured in terms of several feet. Successive layers can be employed advantageously when the cross-sectional dimension of the inflatable forms exceeds 10 feet in diameter.

Figure 4:
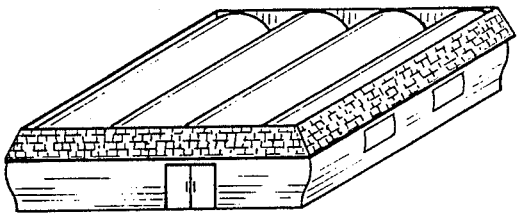
FIG. 4 illustrates a finished mansard-like roofed building with doors and windows employing the concrete structure of FIG. 1.
Figure 6:
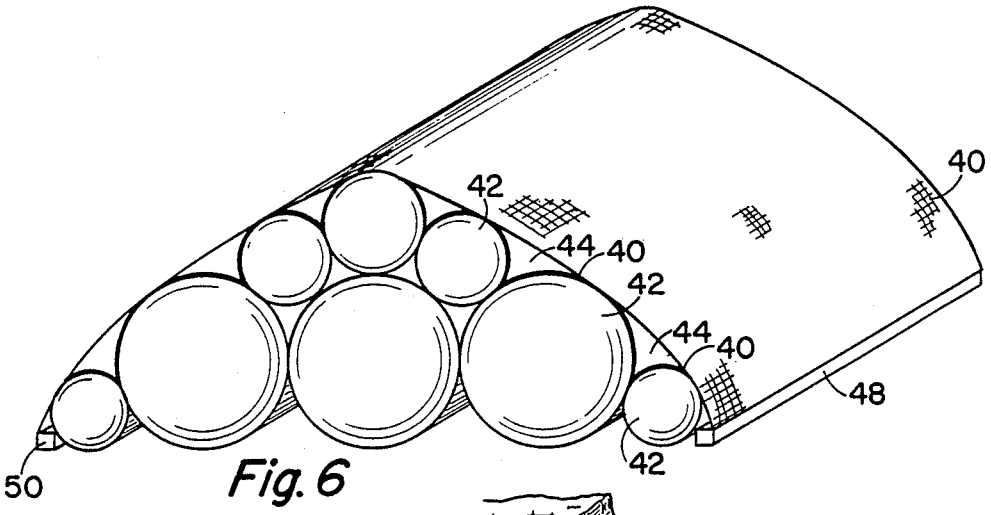
FIG. 6 is a perspective view of an alternate structure according to the present invention employing a plurality of forms with spacer means inserted in the exterior interstitial spaces between adjacent inflatable forms.
Figure 5:
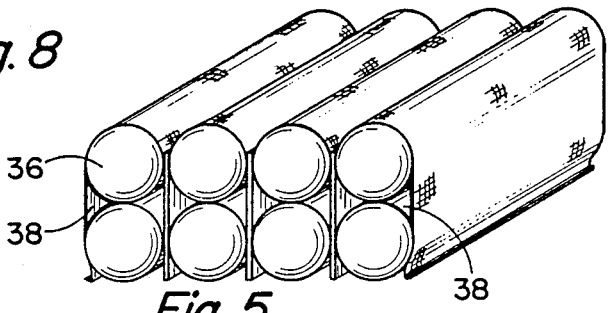
FIG. 5 is a perspective view of an alternate two story embodiment of the structure of FIGS. 1 and 2.

FIGS. 5 and 6 illustrate alternate methods of constructing a thin walled, wire meshed reinforced concrete structure according to the present invention wherein a plurality of inflatable cylindrical forms are stacked on top of each other to form taller structures. FIG. 5 shows a two story version of the barrel vaulted structure similar to FIG. 2 wherein a second layer of inflatable forms 36 is placed directly on top of the lower set of inflatable forms. Spacer means 38 are inserted along the interstitial spaces between the inflatable forms making up the vertical sidewalls to insure a backing when applying concrete. FIG. 6 shows another method of stacking cylindrical forms of varying diameter on top of each other to form a single arched surface. The exterior interstitial spaces 40 formed between adjacent inflatable forms 42 are filled with spacer means 44 to insure a smooth exterior and continuous contact with the wire mesh 46 stretched from one side of the foundation 48 to the other side 50. These spacer means can be made of any convenient lightweight material such as plastic, foam plastic (e.g. beaded polystrene, urethane foam, etc.), hollow plywood forms or combinations thereof and can even be another inflatable form. The actual geometric shape of the building and the inserts can vary from simple cylindrical forms with prismatic-like inserts to spherical inflatable forms with complex shaped inserts as well as other geometric possibilities. In fact, it is contemplated that the barrel rolled concept of the embodiment illustrated in FIGS. 1 through 5 can be used in combination with the insert concept as illustrated in FIGS. 5 and 6 to create an even greater variety of structural designs and surface contours. Optionally, a rigid interior framework can be employed to stretch the wire mesh over, thus creating the ability to produce a conventional roof line appearance or box shaped structure. In such cases, the interstitial spaces between individual inflatable forms can be minimized or eliminated by intentionally allowing an oversized form to expand into the structurally confined wire mesh.

Figure 7:
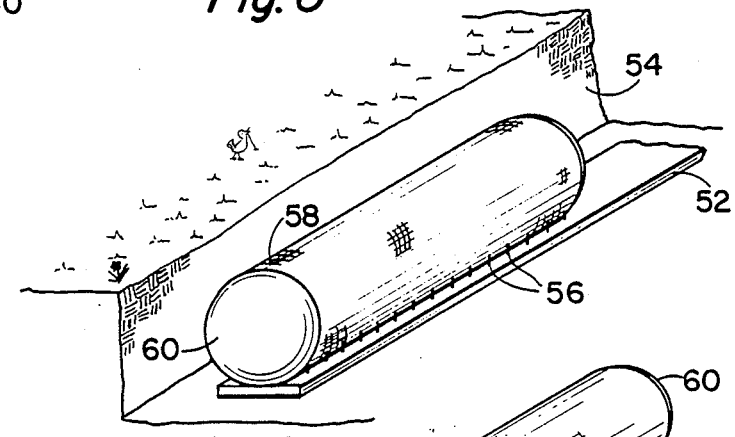
FIG. 7 is a partial cutaway view of the method of manufacturing a pipeline structure according to the present invention.
Figure 8:
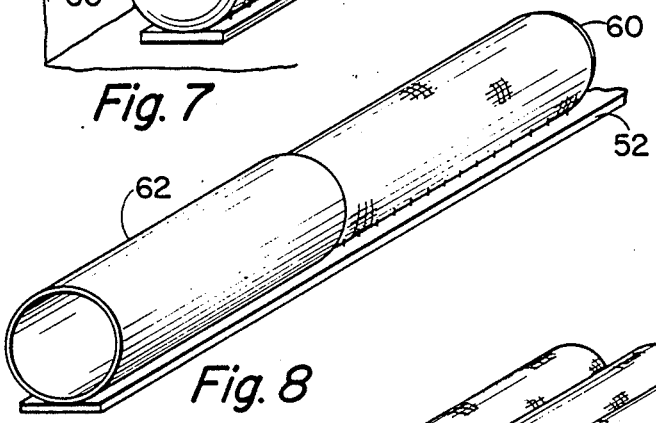
FIG. 8 illustrates the method of extending the pipelire according to the present invention.

FIGS. 7 and 8 illustrate still another specific embodiment of the present invention wherein a slip forming technique is employed to create a pipeline or other relatively elongated structure. As illustrated in FIG. 7, a cement foundation 52 is formed and poured in a trench 54. The respective edges of the foundation 52 are provided with anchor bolts 56 or the equivalent to hold the bands of reinforcing chain link fence fabric 58 in place. An inflatable cylindrical form 60 is placed directly on the foundation 52 and held there by the fencing fabric 58. A layer of cement can then be applied to the wire mesh confined inflatable form thus producing a segment 62 (see FIG. 8) of the cement pipeline. As illustrated in FIG. 8, the inflatable form 60 can be deflated and repositioned along the foundation 52 such that one end of the form remains within the previous constructed pipeline segment 62. The process can be repeated and the foundation extended such as to produce the pipeline. The same concept of slip forming can be readily adapted to the previously described embodiments to produce other elongated structures.

The method of constructing a cement structure according to the present invention is viewed as being advantageously performed in discrete stages. Initially a footing, base, foundation or the like must be provided.

In the case of a building structure, this foundation or base can be manufactured by conventional techniques, while in the slip forming embodiments, provisions for extending the foundation repeatedly may be necessary. The foundation can be conventionally poured, cast, sprayed or troweled with cementitious mixture similar to that which will be used in fabricating the remainder of the structure. Preferably this base is to be steel reinforced and additional steel reinforcing rods can be bent and placed perpendicular to the base at the exterior sidewalls to form a cradle within which the inflatable forms will rest. The presence of this additional rebar at the base will also strengthen the undercut reverse curve portion of the resulting structure. Also, attachment means or anchors can be provided such that the wire mesh can be anchored to the base. The attachment or anchor means can be any of such devices as known in the art, including by way of example, but not limited thereto, eyelets, bolts, hooks, bends at the ends of the reinforcing rods, and the like. The base or foundation is now allowed to set up and partially cure before moving on to the second stage, the placement of wire mesh and inflatable form.

If the embodiment being constructed is to have internal support walls such as the barrel vaulted example of FIGS. 1 through 5, the respective assembling of support posts and rafter beams, again on appropriately provided foundations, is the next step. The inflatable form or plurality of inflatable forms is then positioned within the hardened foundation or base and partially inflated. The appropriate spacer means or lightweight inserts, if used, can then be positioned between the exterior curved recesses of the partially inflated forms. Various methods of temporarily restraining the inserts and stacks of inflatable forms can be readily employed at this stage, including tiedown bands or straps, adhesive tape, and the like. The wire mesh to be placed on the exterior of the form should be sized such that it conforms to the desired internal dimensions of the resulting structure, which is also the exterior size of the inflated forms plus inserts (if any). In this manner the intentional overinflating of the inflatable forms will tend to prestress the wire mesh resulting in increased structural stength of the resulting structure. This intentional high pressure inflation within a confined wire mesh also serves to stabilize the form during application of the concrete mixture.

FIGS. 2 and 7 illustrate particularly preferred methods of enclosing the inflatable forms with a series of parallel bands of chain link fencing fabric. In the case of the pipeline embodiment of FIG. 7, these bands of chain link fencing fabric can be first laid out and attached to the base. The partially inflated form can then be placed on the chain link fence. The bands of chain link fence can then be looped over the form and the ends attached to create a hoop. Alternatively, the inflatable form can first be placed on the base and the respective ends of the bands of the chain link fence fabric attached to the respective sides of the base. As a pragmatic consideration, it has been found that working with a partially inflated form is superior to handling an uninflated form. Also, in the case of the structure of FIG. 2, a series of overlapping segments of chain link fencing fabric can optionally be applied to the ends of the cylindrical forms by attachment to the end of the foundation and the end bands of the chain link fencing already present. In this manner, a hemispherically segmented end wall can be fabricated simultaneously with the rest of the structure. It is also contemplated that various window and door inserts or the like can be attached to the sidewalls as well as the ends to provide for door and window openings. And as illustrated in FIG. 4, a decorative roof and end walls can easily be supplied after completing the fabrication of the concrete shell.

In the case of relatively long structures, and as illustrated in FIGS. 7 and 8, additional steel stiffeners 62 can be employed around the form and wire mesh and anchored to the base or foundation with a slightly smaller diameter than the remaining portion of the form. In this manner, a rigid reinforcing rib will be present in the final structure. Such stiffeners have the additional advantage of reducing the tendency of the form to lift away from the base when cement is being placed nonuniformly on the form.

Figure 9:
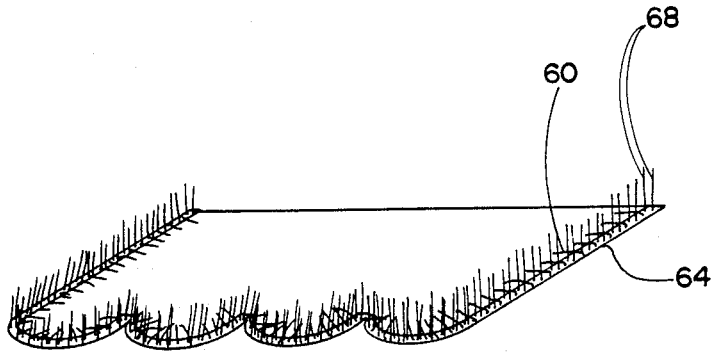
FIGS. 9 through 12 are perspective view of the sequences of steps involved in constructing an arched concrete structure according to the present invention suitable for use as an earthen sheltered building.

FIGS. 9 through 14 illustrate another preferred embodiment of the present invention wherein an arched concrete structure suitable for withstanding an earthen overburden is produced. As such, this particular embodiment is preferably constructed below grade or on a hillside such that the structure can be subsequently buried, creating an earthen shelter. As illustrated, the embodiment differs from the previous embodiments in that the high strength steel bands are utilized to stabilize and confine the overpressurized inflatable form, rebar is used for concrete reinforcement and sequential construction of individual arched segments is employed. As shown in FIG. 9, construction starts with pouring a footing 64 predominantly below grade with preferably two rows of rebar 66 and 68 extending vertically out of the footings. The innew row 66 can be bent inward until horizontal and the floor (see FIG. 10) can then be poured such as to extend over the footings 64. A vertical concrete base 72 can then be formed and poured along the perimeter of the structure wherein walls will be present, thus completing the foundation (again, see FIG. 10).

Figure 10:
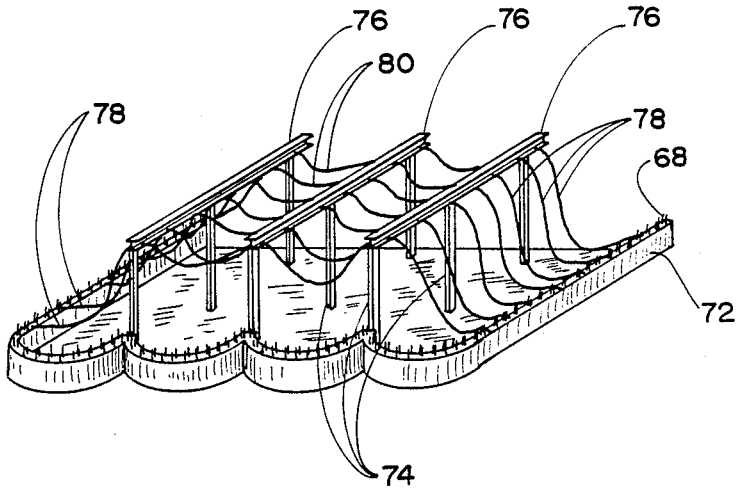

As further illustrated in FIG. 10, the overall configuration of the resulting foundation is adapted to accept four parallel, side by side, cylindrical inflatable forms including domed or hemispherical ends. Between each cylindrical form, before they are placed on the foundation, a plurality of vertical support columns 74 with a horizontal I-beam 76 on top are installed. The vertical support column and I-beam 76 are positioned such that ultimately they will be load bearing members in the final concrete structure with the I-beam being positioned just above the region of contact between parallel cylindrical forms corresponding to the intersection of two arched external roof surfaces of the final structure. It should be appreciated that during construction of the concrete structure, the columns and I-beams may have to be anchored to each other and to the foundation (as illustrated later) because of the lift associated with the overpressured, oversized inflatable forms (as explained later).

Figure 13:
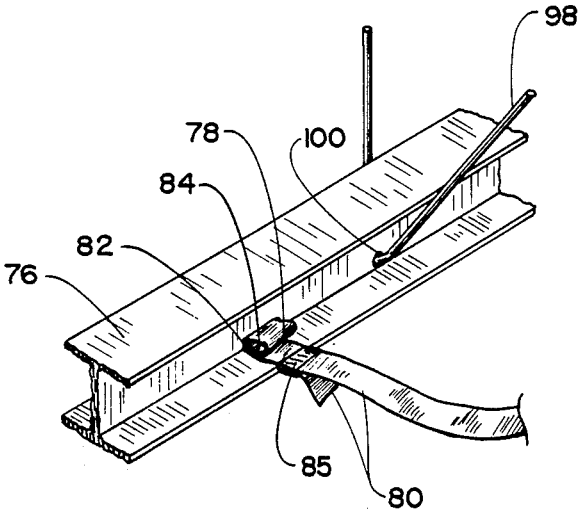
FIGS. 13 and 14 are close-up views of the restraining straps and rebar employed in the embodiment of FIGS. 9 through 12.

Prior to placement of the inflatable forms onto the foundation, a plurality of high strength steel bands or flat straps 78 are attached to the sidewall portions of the concrete base 72 on about a two foot or smaller spacing. The straps are then anchored to the bottom of the I-beam and are of sufficient length to correspond to the desired curvature of the ultimate arched structure. Similarly, steel straps 80 are attached between I-beams again corresponding to the desired radius of curvature of the arched roof of the final concrete structure. FIG. 13 illustrates one convenient method of attaching straps 78 and 80 to I-beam 76 involving cutting a rectangular slot 82 along the bottom of the I-beam 76 and threading both straps 78 and 80 through slot 82 from opposite sides. The straps are then wrapped around a short segment of pipe 84 and rethreaded back through the same slot 82 to their original side. A clamp 85 is then used to hold the loose end of the strap to itself around the pipe. When the inflated form expands creating tension on the strap, the pipe segment 84 will not pass through slot 82 and the strap will then restrain and stabilize the form.

Figure 11:
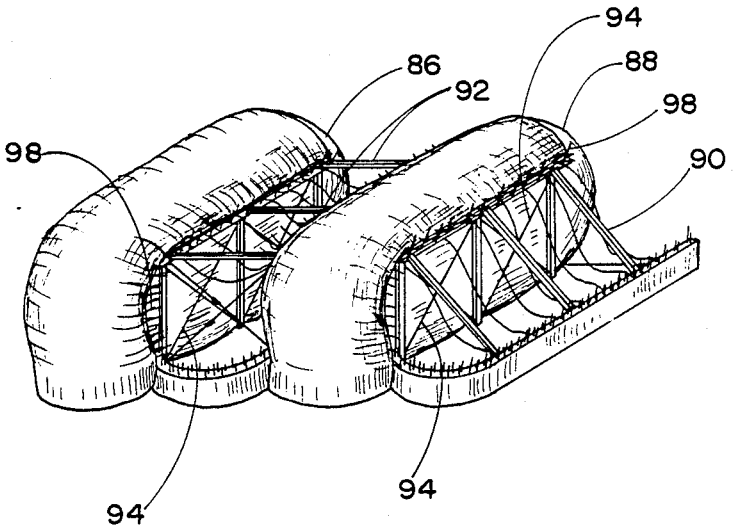

Having installed the restraining straps 78 and 80, inflatable forms 86 and 88 are positioned under the straps and on the foundation. As illustrated in FIG. 11, cross bracing in the form of slanted support members 90 on the outer I-beam, horizontal spacers 92 between inner I-beams, criss-crossed tension wires with turnbuckles 94 along internal walls and criss-crossed tension wires with turnbuckles 96 between inner wall support members are employed to stabilize the support members and anchor them to the foundation. After inflating the forms to a pressure of 20 inches of water or greater, rebar 98 is installed on the entire surface to be sprayed with concrete. Since the inflatable forms 86 and 88 are oversized, the base of the inflatable forms conform to the cross braced support walls. This creates maximum foot plant for the inflatable form (maximum form to foundation contact). The two arched segments containing the inflatable forms 86 and 88 are then sprayed with concrete and allowed to set up forming a structure as illustrated in FIG. 11.

Figure 12:
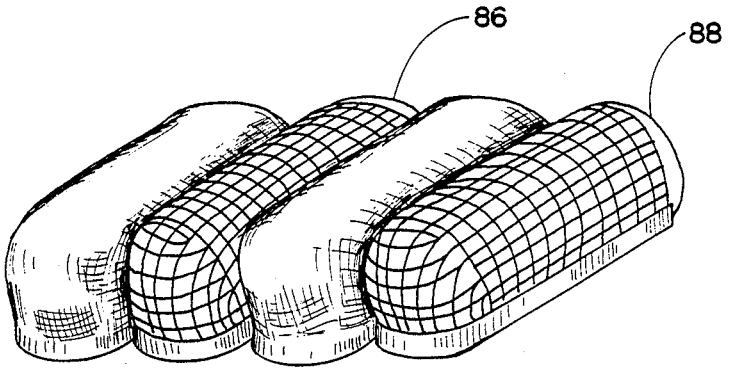

As illustrated in FIG. 12, the two inflatable forms 86 and 88 are then deflated and withdrawn. The cross bracing and inflatable forms are repositioned on the foundation such as to construct the other two arched segments. Rebar is again applied to the two alternate arched sections. These arched sections are then shot with concrete in the manner analogous to the previous arched segments.

Figure 14:
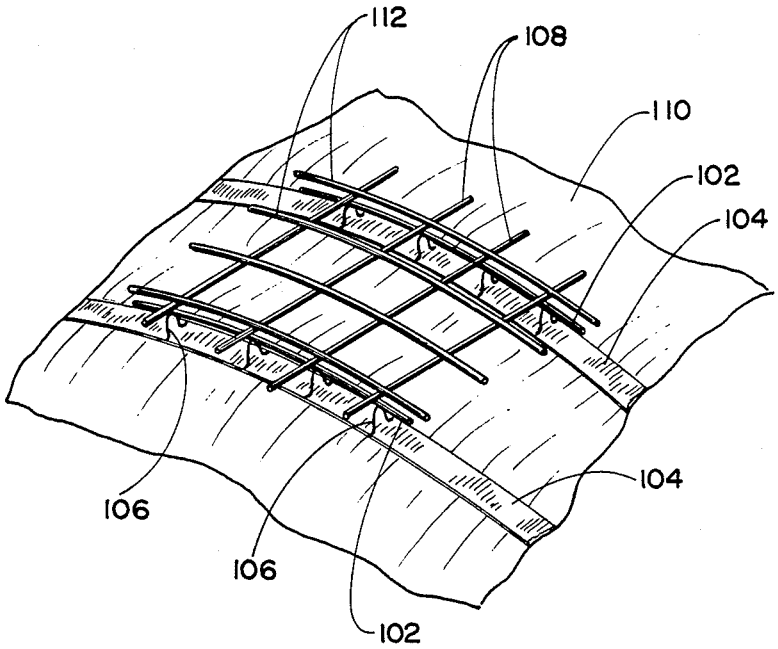

FIGS. 13 and 14 further illustrate one specific preferred method of applying the rebar to the concrete structure. As illustrated in FIG. 12, a hole 100 is drilled periodically along the I-beams 76 such as to insert and retain a V-shaped rebar member contributing strength to the trough between arched segments of the roof. As illustrated in FIG. 14, the surface of the inflatable forms is preferably reinforced by first suspending a rebar 102 directly above each restraining strap 104 by the use of a so-called "high chair" 106. In this manner, longitudinal rebars 108 can be attached to rebar 102 and held above the restrained inflatable form 110. A second set of perpendicular rebar 112 can then be attached to the rebar 108.

Using the method as illustrated in FIGS. 9 through 14, a concrete structure suitable as an earthen shelter was constructed. The foundation and support structure was based on a set of four nominally 12 foot diameter by 25 feet long cylindrical forms using $\frac{3}{4}$ inch high strength steel straps on 2 foot centers for restraining the forms. The actual inflatable forms employed were oversized (13 feet 8 inches in diameter). Air pressure corresponding to 20 inches of water was employed to inflate the forms. The rebar was installed on a nominal 8 inch by 8 inch square pattern supported on rebar at 2 feet or less spacing directly above the streel straps with 3 inch high chairs. Five inches of pea gravel concrete were applied directly to the inflated forms and allowed to set. A subsequent layer of 2 inches water repellant concrete were applied over the pea gravel concrete. Appropriate slope was employed in the trough area corresponding to the inner section of the arched roof. No form deformation and cement sloughing was experienced. The restraining straps were readily removed from the underside of the structure after completion, thus forming a rebar reinforced concrete arched structure sutiable for supporting an earth overburden and live load of 15,000 psi.

The cementitious mixture to be applied to the inflatable form can be any of the concrete or so-called cements well known in the art. Various additives can be readily incorporated into such mixture for various purposes, again as well known in the art. Optionally, a fiber concontaining concrete is employed wherein polyolefin fiber such as polypropylene or polyethylene or metal fibers such as steel are added to enhance the structural strength.

Application of the cementitious mixture can be performed by any of the methods well known in the art. Preferably, the concrete mixture is sprayed onto the steel strap and wire mesh confined inflatable form, but troweling of the concrete mixture is viewed as being equivalent. Because of the highly inflated state of the mold (pressures in excess of about 20 inches of water), the so-called "workdown" process of the prior art methods is not necessary. Depending on the size and geometric shape of the structure, teh spraying or other application of the cement can be staged or interrupted to allow partial setting and curing. In the case of a deeply recessed or reverse curvature form, approximately the lower-one-third to lower two-thirds of the form is sprayed with approximately three-fourths of an inch of cement, and the resulting partially covered form is allowed to set and cure. The upper portion and top of the structure can then be shot with cement without encountering significant form deformation. After curing the entire structure, a second layer of wire mesh can then be applied to the exterior and another layer of cement can be applied to the entire structure in one stage. Although this process may be repeated many times, one layer of rebar reinforced concrete or two layers of wire reinforced concrete are considered sufficient for most applications. With regard to the above, it is felt that achieving the first cured layer of reinforced concrete on the mold is the critical step. Once having achieved a single layer, the structure will havesufficient strength to accept additional layers with or without additional reinforcing.

The restraining straps or bands employed to confine the inflatable form are preferably flexible, high strength steel bands preferably on a two foot or closer spacing. The wire mesh employed to confine the inflatable form is preferably a flexible open mesh screen or woven wire fabric having sufficient thickness and associated relief that it will in part remain suspended away from the inflatable form on which it rests. The use of restraining straps or bands under the wire mesh further insures this feature. In this manner, the wet cement will in part penetrate to the inflatable form and the resulting wire will be embedded into the resulting cement sidewalls. Conventional chain link fabric is ideally suited to serve this purpose.

The inflatable form can generally be any closed geometric shape or size that lends itself to high inflation pressures when confined by the restraining straps and/or flexible wire mesh. Preferably, an oversized cylindrical inflatable form is to be employed. It can be made from any of the elastomeric/flexible materials well known in the art including, but not limited to, rubber, rubberized fabric, thermoplastic film or plastic coated fabric and the like. Preferably, a heavy gauge vinyl coated fabric is to be employed.

The plurality of inflatable forms used to fabricate relatively large structures are preferably oversized and optionally can be interconnected pneumatically. It is felt that using an oversized inflatable form insures maximum foot plant while equalizing the pressure throughout the form by allowing air flow between individual individual inflatable forms may further stabilize the inflated form in a manner analogous to what is experienced in a compartmentized air mattress. Because of these features and the above normal inflation pressure, the process of the present invention allows for extremely safe and inexpensive construction of relatively large structures without experiencing significant form deformation or cement sloughing.

Having thus described and exemplified the preferred embodiments with a certain degree of particularity, it is manifest that many changes can be made within the details of operation of the individual steps, their operating parameters, and sequential implementation without departing from the spirit and scope of this invention. Therefore, it is to be understood that the invention is not limited to the embodiments set forth herein for purposes of exemplification, but is to be limited only by the scope of the attached claims, including the full range of equivalents to which each step thereof is entitled .

I claim:

1. A method of construction a cement building comprising the steps of:

(a) providing a foundation having two sides and adapted to accept a plurality of parallel cylindrical closed inflatable forms in contact with each other and further adapted to accept inner support members between said cylindrical inflatable forms;

(b) providing a plurality of interior vertical support members along a line of contact between each pair of said parallel cylindrical inflatable forms;

(c) providing a substantially horizontal, load bearing, roof support member along the line of the contact between each pair of said parallel cylindrical inflatable forms and wherein each said horizontal roof support member is supported by a respective plurality of said vertical support members along the same line of contact;

(d) placing a plurality of parallel cylindrical inflatable forms within foundation on each side of said substantially horizontal roof support members;

(e) anchoring a flexible wire mesh to said foundation along the sides or said foundation substantially parallel to the direction of said plurality of cylindrical inflatable forms and anchoring said flexible wire mesh to each or said horizontal roof support members such that said flexible wire mesh will conform to and substantially cover the entire exterior surface of said inflatable forms when inflated;

(f) inflating said plurality of parallel cylindrical inflatable forms to prestress said flexible wire mesh, said forms contacting each other after inflation;

(g) applying a wet cementitious material to the prestressed wire meshed exterior of said inflatable forms and roof support members; and (h) allowing said cementitious material to set and harden before deflating and removing said inflatable forms.

2. A method of claim 1 wherein said flexible wire mesh is a series of parallel partially overlapping bands of chain link fence covering the entire desired structure.

3. A method of claim 1 or 2 wherein said cementitious material is a fiber reinforced cement mixture applied by compressed air and said fiber is selected from the group consisting of steel wires, polypropylene fibers, polyethylene fibers, and mixtures thereof.

4. A method of claim 3 including the step of enclosing at least one end of said structure by the application of cementitious material to a tensioned, flexible wire mesh covered end of said inflatable form.

5. A method of claim 1 or 2 wherein said plurality of cylindrical inflatable forms are pneumatically interconnected.

6. A method of constructing a concrete structure comprising the steps of:

(a) pouring a concrete foundation adapted to accept a plurality of closed cylindrical inflatable forms when said forms are positioned side by side in parallel contact with each other wherein the outer perimeter of said foundation is further provided with a plurality of attachment means along the outer side of said inflatable form corresponding to walls of said structure;

(b) erecting a plurality of vertical support members on said foundation along at least one linear line parallel to said foundation attachment means and erecting a substantially horizontal, load bearing, roof support member on the top of said vertical support members along each linear line wherein said roof support members are provided with a plurality of attachment means along said roof support members;

(c) attaching flexible inflatable form restraining means between said attachment means along each of said roof support member, and between attachment means along respective roof support members and said attachment means along said foundation wherein said restraining means are adapted to restrain a closed cylindrical inflatable form to a desired arched contour;

(d) placing at least one oversized cylindrical inflatable form on said foundation under said restraining means and inflating said inflatable form; and (e) applying a wet cementitious material to the outer surface of said restrained inflated form and allowing said cementitious material to set and harden thus forming an arched cement structure.

7. A method of claim 6 wherein said flexible inflatable form restraining means are a plurality of essentially parallel flat high strength straps circumferentially positioned around each segment of said cylindrical inflatable form corresponding to an arched sidewall and roof member of the concrete structure.

8. A method of claim 7 further comprising the step of attaching and suspending a layer of reinforcing rods over the entire surface of said inflatable form corresponding to the outer surface of the concrete structure wheren said layer of reinforcing rods is displaced slightly away from the inflatable form and restraining straps after inflating said form and before applying said wet cementitious material.

9. A method of constructing a concrete structure comprising the steps of:

(a) pouring a concrete foundation adapted to accept a plurality of closed cylindrical inflatable forms when said forms are positioned side by side in parallel contact with each other defining a region of contact therebetween and wherein the outer perimeter of said foundation is further provided with a plurality of attachment means along the outer side of said parallel contacting inflatable forms corresponding to the walls of said structure;

(b) erecting a plurality of vertical support members along each region of contact between said inflatable forms wherein said support members terminate essentially at the top of the region of contact of said inflatable forms and erecting substantially horizontal load bearing roof support members on the top of said vertical support members along and slightly above said region of contact between said inflatable forms wherein said roof support members are provided with a plurality of attachment means along said roof support members;

(c) attaching flexible inflatable form restraining means between said attachment means along said roof support member and attachment means along another of said roof support members and attachment means along said foundation wherein said restraining means are adapted to restrain closed cylindrical inflatable forms to a desired arched contour;

(d) placing a plurality of oversized cylindrical inflatable forms on said foundation under said restraining means and inflating said inflatable forms;

(e) applying a wet cementitious material to less than all of said inflatable forms at one given time such that individual arch members making up the concrete structure are constructed sequentially by repeating steps (d) and (e) sequentially and wherein said adjacent vertical support members with horizontal roof support members are stabilized relative to each other by cross bracing when said cementitious material is being applied to an inflated form at another position of the cement structure.

* * * * *